US006036332A

United States Patent [19]

Antal

[11] Patent Number: 6,036,332

[45] Date of Patent: Mar. 14, 2000

[54] ILLUMINATING CENTERPUNCH

[76] Inventor: Charles B. Antal, 7004 B. Lower Bridge Rd., Everett, Wash. 98203

[21] Appl. No.: 09/178,446

[22] Filed: Oct. 23, 1998

Related U.S. Application Data

[60] Provisional application No. 60/093,095, Jul. 16, 1998.

[51] Int. Cl.[7] ..... F21V 33/00

[52] U.S. Cl. ..... 362/119; 362/118; 362/120; 33/670; 33/671

[58] Field of Search ..... 362/119, 118, 362/120; 33/670, 671, 673, 674

[56] References Cited

U.S. PATENT DOCUMENTS

| | | | |
|---|---|---|---|
| D. 354,663 | 1/1995 | Clark et al. | D8/47 |
| 4,069,586 | 1/1978 | Skelton . | |
| 4,083,109 | 4/1978 | Homs | 1/32 |
| 4,768,137 | 8/1988 | Hsaw et al. | 362/119 |
| 5,343,376 | 8/1994 | Huang | 362/259 |
| 5,690,414 | 11/1997 | Jeng | 362/120 |
| 5,713,656 | 2/1998 | Lin | 362/120 |

*Primary Examiner*—Cassandra Spyrou
*Assistant Examiner*—Mohammad Y. Sikder
*Attorney, Agent, or Firm*—Dean A. Craine

[57] ABSTRACT

An illuminated centerpunch designed to illuminate the area on a workpiece where a punch mark is to be made. The centerpunch includes a hollow, cylindrical-shaped main body. Attached to the proximal end of the main body is a replaceable striking cap. Disposed inside the main body is a bulb holding collar acts as a switch and which holds a plurality of bulbs. Attached to the distal end of the main body is a post assembly designed to hold a replaceable tip and the bulb holding collar inside the main body. Attached over the distal end of the main body and around the replaceable tip is an optical end assembly. The optical end assembly includes a ring plate with a plurality of radially, spaced-apart arms which extend distally and curve inward from the main body. Located inside each arm is a fiberoptic capable of transmitting light produced by the bulbs located inside the main body to a desired point on the work surface. Disposed inside the main body are batteries electrically connected to the bulbs.

7 Claims, 2 Drawing Sheets

ILLUMINATING CENTERPUNCH

This is a utility patent application based on a provisional patent application filed on Jul. 16, 1998 (U.S. Ser. No. 60/093,095).

BACKGROUND OF THE INVENTION

1. Field of the Invention

This invention relates to a hand tool designed to locate and mark a point on a work surface and, more particularly, to such a hand tool having illuminating means.

2. Description of the Related Art

Centerpunches are commonly used to locate and mark a desired point on a work surface. In some instances, the work surface must be adequately illuminated so that a desired point can be precisely located and marked. In other instances, the centerpunch is used to remove a broken stud or bolt which requires that the center of the bolt or stud be located for drilling. In both instances, a circular, equidistant pattern of light around the tip of the centerpunch would be helpful.

During use, substantial striking force must be applied to the striking end of the centerpunch. Eventually with continuous use, the striking end and the tip of the centerpunch are deformed which requires that they be re-grounded or that the entire centerpunch be replaced.

Because the substantial striking force applied to the centerpunch, an illuminating means or other electronic components located inside the centerpunch may be damaged.

What is needed is an illuminated centerpunch capable of producing a circular equidistant pattern of light around the tip of the centerpunch, with a replaceable striking surface and replaceable tip that is sufficiently durable to withstand the striking force. Further, what is needed is such a centerpunch with an unobstructed view of the desired point to be marked.

SUMMARY OF THE INVENTION

It is an object of the invention to provide a centerpunch.

It is another object of the invention to provide a centerpunch with illuminating means.

It is another object of the invention to provide such a illuminated centerpunch which creates a circular pattern of light around the point to be marked, and which is sufficiently durable.

These and other objects are met by providing an illuminated centerpunch designed to illuminate the area on a workpiece where a punch mark is to be made. The centerpunch includes a hollow, cylindrical-shaped main body. Attached to the proximal and distal ends of the main body is a replaceable striking cap and tip, respectively.

Attached to the distal end of the main body is an optical end assembly. The optical end assembly includes a plurality of radially, spaced-apart arms which extend longitudinally and curve inward from the distal end of the main body. Located inside each arm is an optic fiber capable of transmitting light from a light source located inside the main body to a desired point on the work surface. The light source is contained in a holding collar that absorbs a minimal amount of the force exerted on the striking end during normal use. The arms curve inward toward the tip so that light transmitted from the optic fibers illuminate a desired area around the point to be marked. The arms are also sufficiently spaced apart to provide the user an unobstructed view of the surface to be marked. A switch means is also provided to selectively control the activation and deactivation of the light source.

DESCRIPTION OF THE PREFERRED EMBODIMENT(S)

Figure 1:
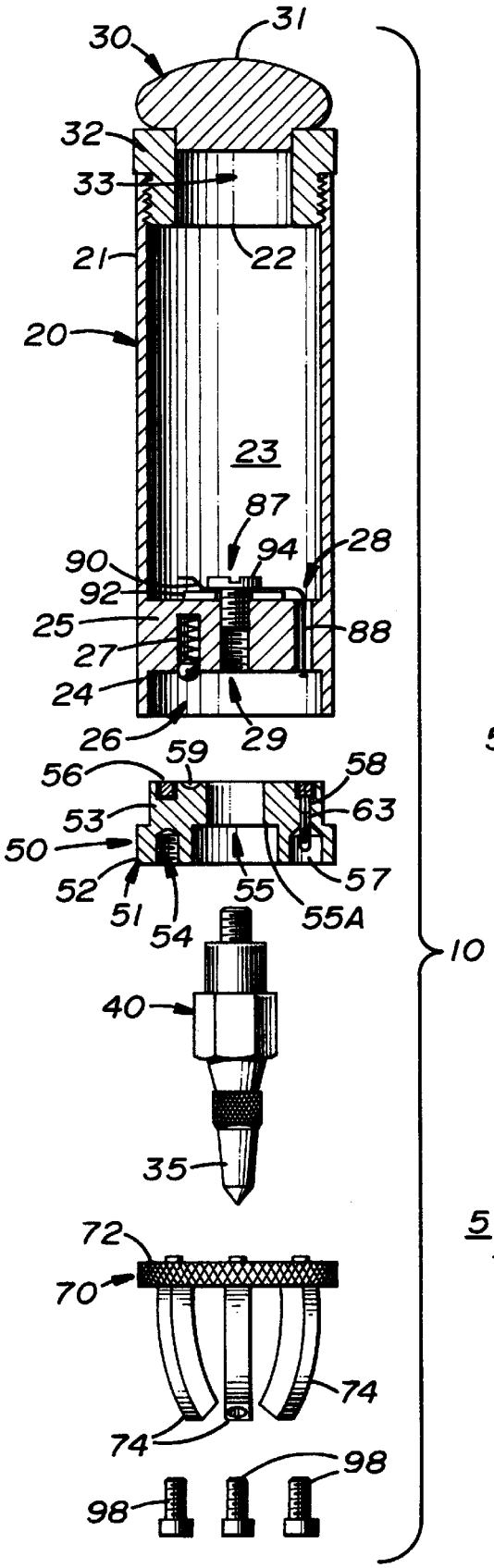
FIG. 1 is a sectional, side elevational view of the illuminating centerpunch.
Figure 2:
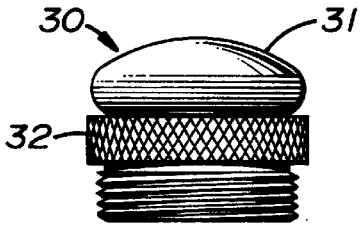
FIG. 2 is a side elevational view of the striking cap.
Figure 3:
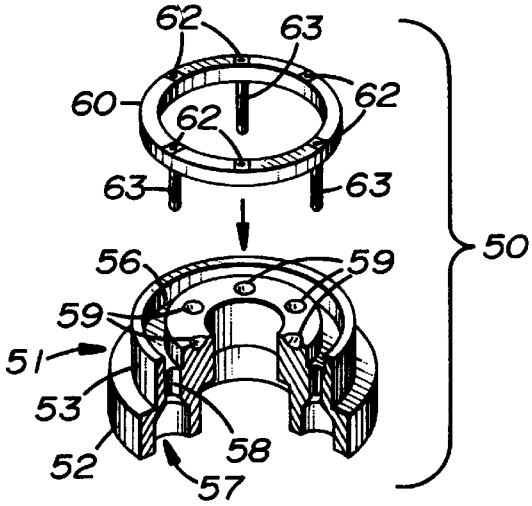
FIG. 3 is an exploded, perspective view of the bulb holding collar.
Figure 4:
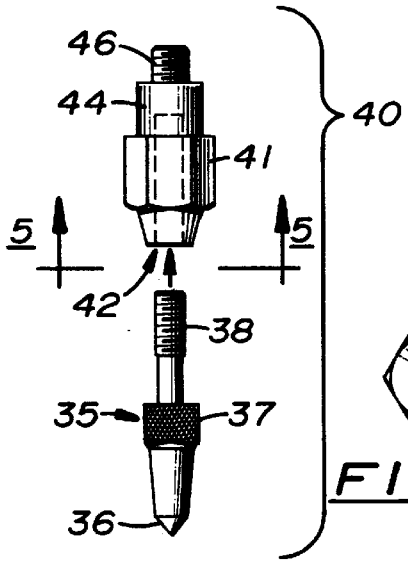
FIG. 4 is an exploded, side elevational view of the post assembly.
Figure 5:
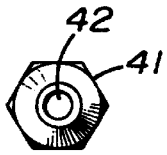
FIG. 5 is a bottom plan elevational view of the post assembly taken along line 5—5 in FIG. 4.

Shown in the accompanying FIGS. 1–10, there is shown an illuminating centerpunch, generally referred to as 10, designed to illuminate a desired point to be marked on a work surface.

The centerpunch 10 includes a hollow, cylindrical-shaped main body 20 having opposite proximal and distal ends 21, 24, respectively. Formed inside the main body 20 is a longitudinally aligned bore 23 which extends from the proximal end 21 to approximately three-fourths the length of the main body 20. Formed on the inside surface of the main body 20 near the proximal end 21 are internal threads 22.

Formed on the distal end 24 of the main body 20 is a short recessed space 26. The recessed space 26 extends longitudinally into the main body 20 and terminates before communicating with the central bore 23 thereby forming a solid transversely aligned, integrally formed intermediate section 25 within the main body 20.

Formed longitudinally in the intermediate section 25 are a plurality of partially extending, spring receiving bores 27 and at least one fully extending pin bore 28. The spring receiving bores 27 are longitudinally aligned with the main body 20*g* radially spaced apart on the intermediate section 25 and open towards the recess space 26. The pin bore 28 is also longitudinally aligned with the main body 20 and is located near the sidewall of the body 20. Also formed centrally through the intermediate section 25, is a longitudinally aligned fully extending threaded bore 29.

Attached to the proximal end 21 of the main body 20 is a replaceable striking cap 30. The striking cap 30 includes an upper striking surface 31 and an integrally formed, longitudinally aligned threaded neck 32. Formed inside the striking cap 30 is an upward extending cavity 33 in which the electronic module may be partially disposed which is used to control the light source. During assembly, the threaded neck 32 removably attaches to the internal threads 22 located near the proximal end 21 of the main body 20 thereby enabling batteries located inside the main body 30 to be replaced.

During assembly, a bulb holding collar 50 is disposed inside the recessed space 26 on the main body 20. The bulb holding collar 50, which also functions as one component of a light switch, includes a cylindrically-shaped support member 51. Support member 51 includes a distal neck section 52 having approximately the same diameter as the main body 20, and an integrally attached, smaller diameter proximal neck section 53 during assembly. The proximal neck section 53 slip-fits into the short recessed space 26 on the main body 20. Extending longitudinally inside the bulb holding collar 50 from the distal end surface are radially spaced apart, partially extended threaded bores 54. The bores 54 are approximately the same length as the distal neck section 52. Also, formed centrally and longitudinally inside the bulb holding collar 50 is a central bore 55. The central bore 55 narrows thereby forming a stop surface 55*a*. Formed on the distal surface of the bulb holding collar 50 are a plurality of longitudinally, radially aligned bulb bores 57. Each bulb bore 57 narrows at approximately its mid-point to form a longitudinally aligned bulb receiving channel 58.

A narrow circular channel 56 is formed on the top surface of the proximal neck section 53 of the bulb holding collar 50 which houses a ring-shaped bulb assembly 60. The bulb assembly 60 is square in cross-section with six metal contacts 62 spaced apart and radially aligned on its distal surface. During assembly, three bulbs 63 are attached to alternating contacts 62 and extend longitudinally downward therefrom and into the bulb receiving channels 58 on the bulb holding collar 50.

Longitudinally aligned and attached to the threaded bore 29 on the intermediate section 25 on the main body 20 is the post assembly 40. The post assembly 40 includes main section 41, a threaded bore 42 formed inside the main section 41, an integrally formed intermediate section 44, and a threaded neck 46.

During assembly, the post assembly 40 is aligned over the bulb holding collar 50 so that the intermediate section 44 extends through the central bore 55 on the bulb holding collar 50. The threaded neck 46 is then rotated to connect to the threaded bore 29 on the main body 20. The intermediate section 44 is hexagonal in cross-section and is used as a tightening surface for securely attaching the post assembly 40 to the main body 20. As the post assembly 40 is tightened, the main section 41 is forced against the stop surface 55*a* within the central bore 55 to hold the bulb holding collar 50 in place within the recessed space 26. When the post assembly 40 is securely tightened, the bulb holding collar 50 is allowed to rotate on the main body 20 and act as a light switch.

A replaceable tip 35 is longitudinally aligned and connected to the threaded bore 42 located on the post assembly 40. The tip 35 includes a sharpened point 36, an integrally formed knurled surface 37, and a longitudinally aligned threaded neck 38. During assembly, the threaded neck 38 attaches to a threaded bore 42. It should be understood that the tip 35 could be integrally formed on the post assembly 40.

Figure 6:
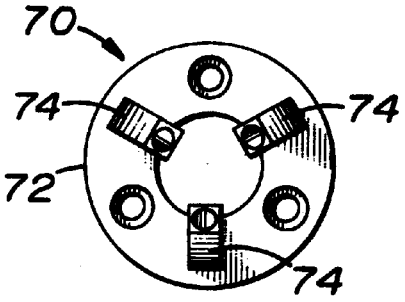
FIG. 6 is a bottom plan view of the optical end assembly.
Figure 7:
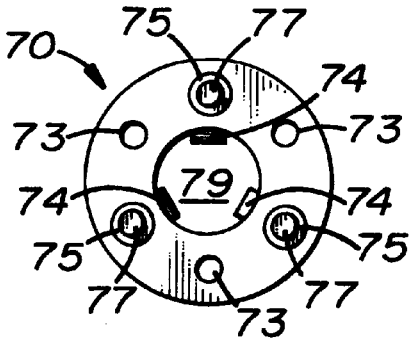
FIG. 7 is a top plan view of the optical end assembly.
Figure 9:
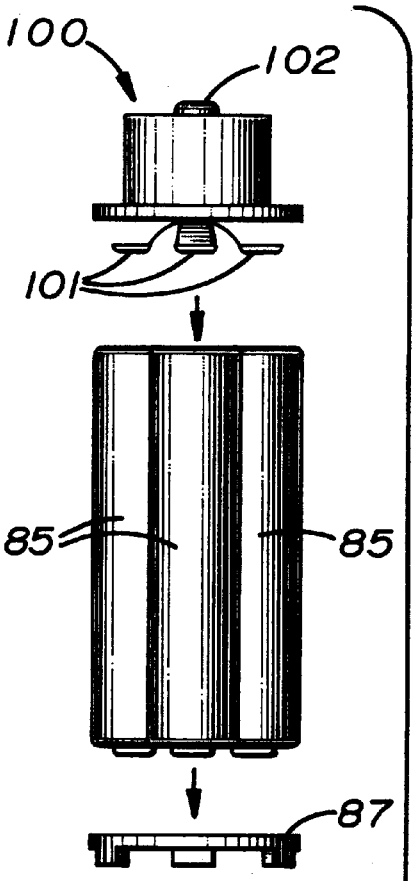
FIG. 9 is an exploded, side elevational view of the battery and the upper and lower connecting terminals.
Figure 8:
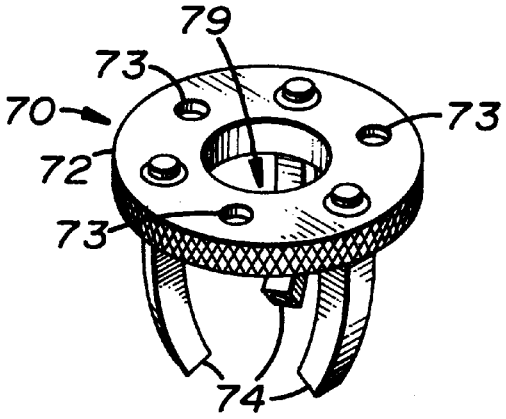
FIG. 8 is a perspective view of the optical end assembly shown in FIGS. 6 and 7.
Figure 10:
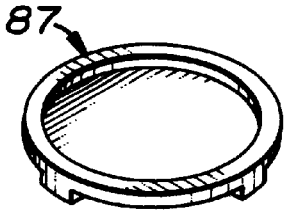
FIG. 10 is perspective view of the lower battery terminal.

Attached to the distal end of the main body 20 and around the tip 35 is an optical end assembly 70. As shown in FIGS. 6–8, the optical end assembly 70 includes a circular ring plate 72 with at least three, longitudinally aligned, inward curved arms 74. Formed around and near the peripheral edge of the ring plate 72 are a plurality of spaced-apart bores 73 designed to receive bolts 98 that attach the threaded bores 54 formed on the distal surface of the bulb holding collar 50. Also, formed inside each curved arm 74 is a longitudinally aligned passageway 75 designed to receive a continuous optic fiber 77. After assembly, an optic fiber 77 is disposed inside the passageway so that its proximal end is disposed adjacent to a bulb 63 located on the bulb holding collar 50 and its distal end terminates near the distal end of the curved arm.

Attached to the inside surface of the intermediate section 25 and inside bore 23 is a battery connection terminal 87. In the embodiment shown, the battery connection terminal 87 includes a pin contact 88, a copper washer 90, an insulation washer 92, and a nylon screw 94.

During assembly, three 1.5 volt D.C. batteries 85 are longitudinally aligned and disposed inside bore 23. After placing the batteries 85 inside the bore 23, an electronic module 100 with a group of three contacts 101 placed against the negative ends of the batteries 85 and one spring loaded contact 102 placed in the center of the proximal end is placed against the striking cap 30. The electronic module 100 serves two functions: it provides a contact point for the negative terminal of the batteries; and the circuitry inside the module turns the bulbs 63 on or off as the bulb holding collar 30 is turned through its six detentes. An optional timing circuit may be coupled to the module which turns the lights off automatically after a few minutes in order to conserve battery power.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. An illuminated centerpunch, comprising:

a. a hollow, main body having a proximal end and a distal end, said distal end having a recessed space;

b. a striking cap attached to said proximal end of said main body;

c. a longitudinally aligned tip attached to said distal end of said main body;

d. a cylindrical bulb holding collar having a distal neck and a proximal neck, said proximal neck is slip-fitted into said recessed space of said main body, at least a longitudinally, radially aligned bulb bore is formed on top surface of said distal neck, said bulb bore narrows to form a longitudinally aligned bulb receiving channel and a narrow circular channel is formed on top surface of said proximal neck;

e. a ring-shaped bulb assembly with at least one bulb extends longitudinally downward therefrom, said ring-shaped bulb assembly being disposed over said top surface of said distal neck so that said bulb extends into said bulb receiving channel;

f. an electric power means connected to said bulb on said bulb holding collar; and g. optical end assembly disposed over said distal end of said main body, said optical end assembly extending longitudinally from said main body and around said tip.

2. An illuminated centerpunch as recited in claim 1 wherein said bulb holding collar is selectively rotated to open and close the electric connection between said bulb and said power means.

3. An illuminated centerpunch as recited in claim 1 wherein said tip is replaceable.

4. An illuminated centerpunch as recited in claim 3, further including said tip being selectively attachable to a post assembly used to hold said bulb holding collar to said main body.

5. An illuminated centerpunch as recited in claim 4 wherein said optical end assembly includes at least one extending arm with a passageway formed therein enabling said bulb to illuminate the area to be marked by said tip.

6. An illuminated centerpunch as recited in claim 5 wherein said extending arm extends inward.

7. An illuminated centerpunch as recited in claim 5, further including a fiber optic disposed inside said extending arm.

* * * * *